US010119372B2

(12) United States Patent
Braithwaite

(10) Patent No.: US 10,119,372 B2
(45) Date of Patent: Nov. 6, 2018

(54) SYSTEM AND METHOD FOR HIGH-PRESSURE HIGH-TEMPERATURE TIEBACK

(75) Inventor: Julian Braithwaite, Leeds (GB)

(73) Assignee: Cameron International Corporation, Houston, TX (US)

( * ) Notice: Subject to any disclaimer, the term of this patent is extended or adjusted under 35 U.S.C. 154(b) by 1495 days.

(21) Appl. No.: 13/031,502

(22) Filed: Feb. 21, 2011

(65) Prior Publication Data

US 2012/0211236 A1 Aug. 23, 2012

(51) Int. Cl.
*E21B 43/10* (2006.01)
*E21B 33/038* (2006.01)
*E21B 33/043* (2006.01)

(52) U.S. Cl.
CPC ..... *E21B 43/10* (2013.01); *E21B 33/038* (2013.01); *E21B 33/043* (2013.01)

(58) Field of Classification Search
USPC .... 166/117.7, 338, 339, 343, 382, 89.3, 348
See application file for complete search history.

(56) References Cited

U.S. PATENT DOCUMENTS 4,607,865 A * 8/1986 Hughes ..... 285/18
4,653,589 A * 3/1987 Alandy ..... 166/382
4,995,464 A * 2/1991 Watkins et al. ..... 166/382
5,311,947 A * 5/1994 Kent et al. ..... 166/348
5,421,407 A * 6/1995 Thornburrow ..... 166/85.3
5,450,904 A * 9/1995 Galle ..... 166/348
6,328,108 B1 * 12/2001 Vanderford et al. ..... 166/348
6,516,887 B2 * 2/2003 Nguyen et al. ..... 166/348
7,219,738 B2 * 5/2007 Reimert ..... 166/348
8,006,764 B2 * 8/2011 Adamek et al. ..... 166/348
8,127,853 B2 * 3/2012 Pallini et al. ..... 166/345
2006/0191680 A1 8/2006 Nelson et al.
2007/0251704 A1 11/2007 Reimert et al.
2009/0277645 A1 11/2009 Pallini et al.
2009/0322030 A1 12/2009 Pallini, Jr. et al.

OTHER PUBLICATIONS

International Search Report and Written Opinion of the ISA dated May 14, 2012 for corresponding PCT Application No. PCT/US2012-024809 filed Feb. 13, 2012.

* cited by examiner

*Primary Examiner* — Matthew R Buck
*Assistant Examiner* — Aaron L Lembo
(74) *Attorney, Agent, or Firm* — Chamberlain Hrdlicka

(57) ABSTRACT

A high-pressure, high-temperature tieback system including a production casing tieback tool consisting of a ratchet-latch sleeve disposed in a recessed portion of an annular extension of increased wall thickness of the production casing tieback tool and a production casing mudline hanger disposed about the production casing tieback tool. The production casing tieback tool is configured to directly engage the production casing mudline hanger. The ratchet-latch sleeve is configured to directly engage a threaded axial segment of a tubular other than the production casing mudline hanger.

12 Claims, 5 Drawing Sheets

SYSTEM AND METHOD FOR HIGH-PRESSURE HIGH-TEMPERATURE TIEBACK

BACKGROUND

Offshore wells may be pre-drilled to minimize downtime of a production platform before the well produces hydrocarbons. A drilling template is installed on the seabed and a drilling rig (e.g., a jackup rig) is positioned over the drilling template. A mudline suspension system is installed when drilling. The mudline suspension system comprises a series of concentric mudline hangers (e.g., one for each casing string) and an internal profile to receive a hanger. The mudline hangers are used to support casing string weight at the mudline. On completion of drilling, abandonment caps can be run into the mudline system to seal and plug the well.

Subsequently, a production platform is positioned over the drilling template and tieback strings may be stabbed into the mudline suspension system, by means of tieback tools at the lower end of each tieback strings, to extend the casing conduits back to a wellhead on the platform. Once the casing strings have been tied back to the surface, the tubing completion string is run and well production may begin after perforation.

Wells typically require running of several concentric casing strings. The innermost casing string, which receives the completion tubular, is called the production casing. This string typically extends into the hydrocarbon bearing zone, and is therefore required to be of high integrity.

Traditional stab-in solutions for coupling the production casing tieback tool to the production casing mudline hanger require that sections of the production casing tieback tool have a reduced wall thickness to accommodate coupling mechanisms. This reduced wall thickness is unacceptable for high-pressure, high-temperature ("HPHT") applications. As a result, the above-described method of pre-drilling offshore wells to the production casing stage is not suited for use in HPHT applications and the efficiencies resulting from pre-drilling offshore wells are not fully realized in HPHT applications.

SUMMARY OF DISCLOSED EMBODIMENTS

In accordance with various embodiments, a high-pressure, high-temperature tieback system including a production casing tieback tool consisting of a ratchet-latch sleeve disposed in a recessed portion of an annular extension of increased wall thickness of the production casing tieback tool and a production casing mudline hanger disposed about the production casing tieback tool. The production casing tieback tool is configured to directly engage the production casing mudline hanger. The ratchet-latch sleeve is configured to directly engage a threaded axial segment of a tubular other than the production casing mudline hanger.

In accordance with another embodiment, a method of stabbing a high-pressure, high-temperature tieback tool into a mudline hanger of a high-pressure, high-temperature well, includes applying a motive force to the tieback tool to engage a ratchet-latch sleeve with a threaded surface of a tubular other than the mudline hanger. The method also includes coupling the tieback tool to the mudline hanger by rotating the tieback tool relative to the tubular other than the mudline hanger.

BRIEF DESCRIPTION OF THE DRAWINGS

For a more detailed description of the embodiments, reference will now be made to the following accompanying drawings.

DETAILED DESCRIPTION OF THE DISCLOSED EMBODIMENTS

Figure 1:
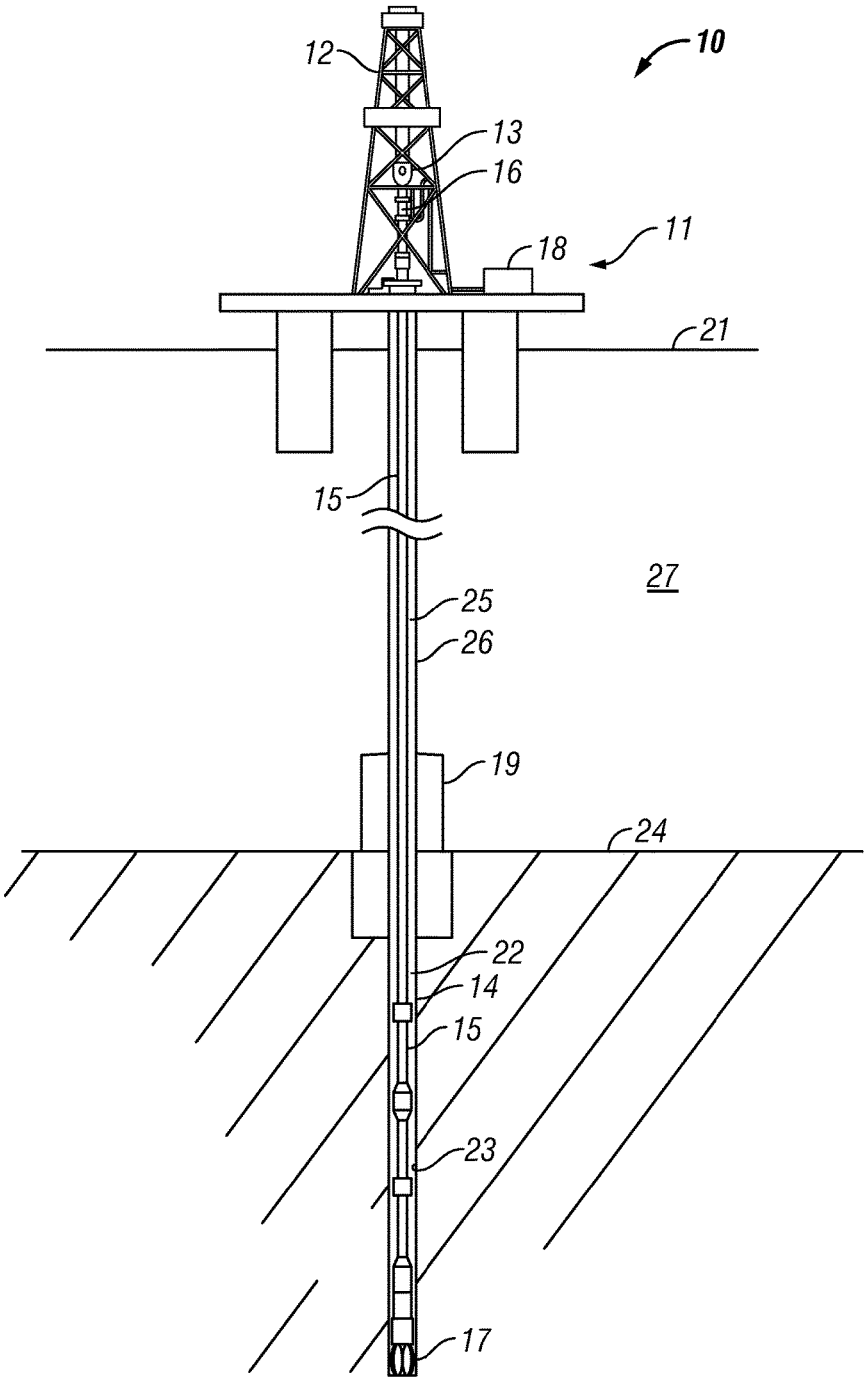
FIG. 1 shows an offshore sea-based drilling system in accordance with various embodiments.

In the drawings and description that follows, like parts are marked throughout the specification and drawings with the same reference numerals. The drawing figures are not necessarily to scale. Certain features of the invention may be shown exaggerated in scale or in somewhat schematic form and some details of conventional elements may not be shown in the interest of clarity and conciseness. The invention is subject to embodiments of different forms. Some specific embodiments are described in detail and are shown in the drawings, with the understanding that the disclosure is to be considered an exemplification of the principles of the invention, and is not intended to limit the invention to the illustrated and described embodiments. The different teachings of the embodiments discussed below may be employed separately or in any suitable combination to produce desired results. The terms "connect," "engage," "couple," "attach," or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring now to FIG. 1, a schematic view of an offshore drilling system 10 is shown. Drilling system 10 comprises an offshore drilling rig 11 equipped with a derrick 12 that supports a hoist 13. In some embodiments, the drilling rig 11 may comprise a jack-up rig. Drilling of oil and gas wells is carried out by a string of drill pipes connected together by "tool" joints 14 so as to form a drill string 15 extending subsea from platform 11. The hoist 13 suspends a kelly 16 used to lower the drill string 15. Connected to the lower end of the drill string 15 is a drill bit 17. The bit 17 is rotated by rotating the drill string 15 and/or a downhole motor (e.g., downhole mud motor). Drilling fluid, also referred to as drilling "mud", is pumped by mud recirculation equipment 18 (e.g., mud pumps, shakers, etc.) disposed on platform 11. The drilling mud is pumped at a relatively high pressure and volume through the drilling kelly 16 and down the drill string 15 to the drill bit 17. The drilling mud exits the drill bit 17 through nozzles or jets in face of the drill bit 17. The mud then returns to the platform 11 at the sea surface 21 via an annulus 22 between the drill string 15 and the borehole 23, through subsea wellhead 19 at the sea floor 24, and up an annulus 25 between the drill string 15 and a casing 26 extending through the sea 27 from the subsea wellhead 19 to the platform 11. At the sea surface 21, the drilling mud is cleaned and then recirculated by the recirculation equipment 18. The drilling mud is used to cool the drill bit 17, to carry cuttings from the base of the borehole to the platform 11, and to balance the hydrostatic pressure in the rock formations.

In accordance with various embodiments, a mudline suspension system is installed at the seabed when drilling is complete. The mudline suspension system allows the well to be plugged, tied back to the surface at a later time using a tieback tool, and used for the production of hydrocarbons (i.e., the well is "pre-drilled"). In some embodiments, the mudline suspension system and the tieback tool are designed to accommodate a well that produces under HPHT conditions.

Figure 2:
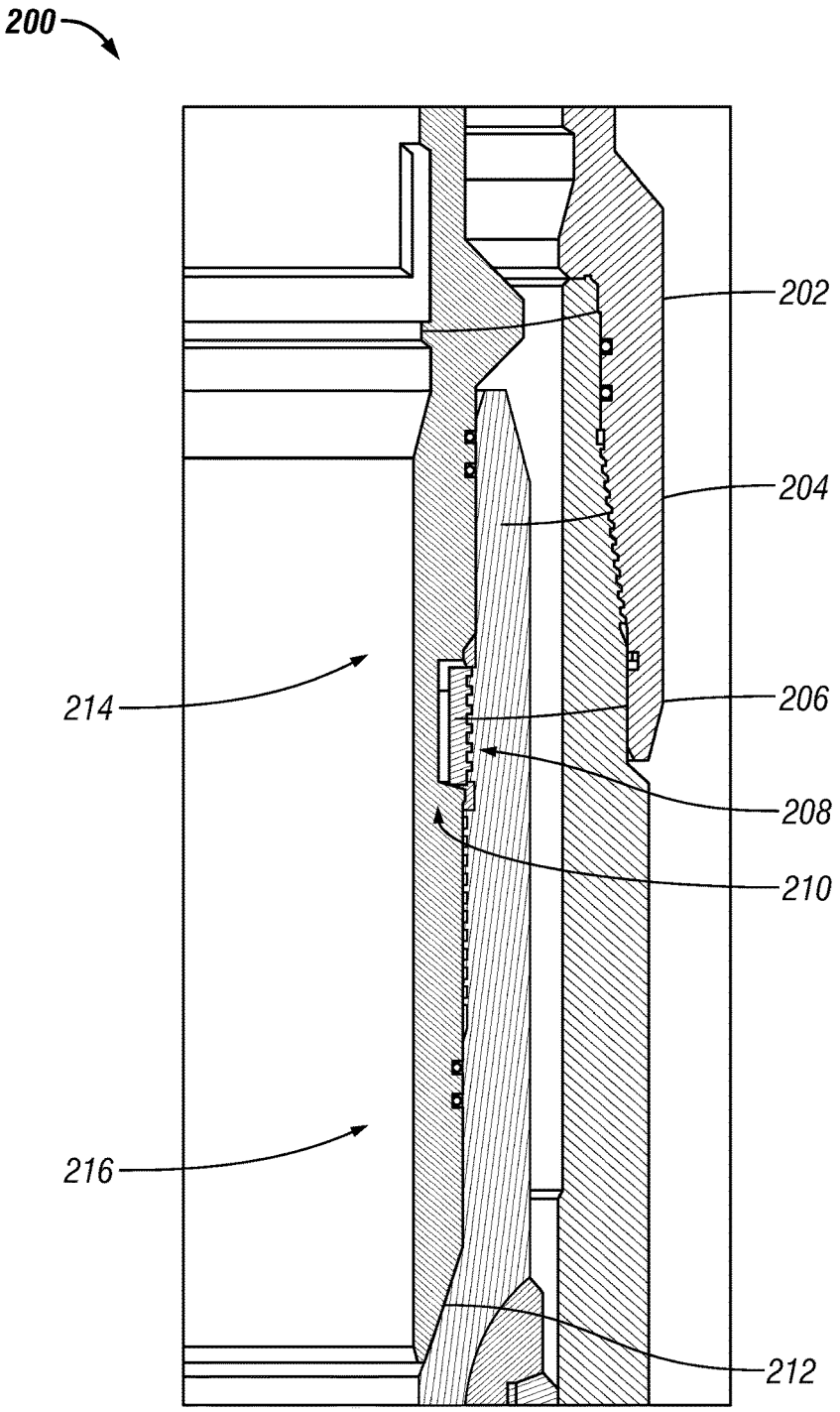
FIG. 2 shows a prior-art tieback.

FIG. 2 shows a prior art tieback solution 200. The solution 200 is shown in a stabbed-in configuration with a production casing tieback tool 202 stabbed into a production casing mudline hanger 204. A ratchet-latch mechanism 206 coupled to the production casing tieback tool 202 engages a threaded portion 208 of the production casing mudline hanger 204. Additionally, a tapered metal-to-metal seal 212 is formed between the production casing tieback tool 202 and the production casing mudline hanger 204, containing fluids inside the production casing tieback tool 202. The ratchet-latch mechanism 206 is contained in an annular recess 210, which results in an area of reduced overall wall thickness compared to the wall thickness of the rest of the production casing tieback tool 202 and the production casing mudline hanger 204 in regions 214, 216. As a result of this reduced thickness, the prior art tieback solution 200 is not suited for use in HPHT applications, where the annular recess 210 is a point of weakness.

Figure 3A:
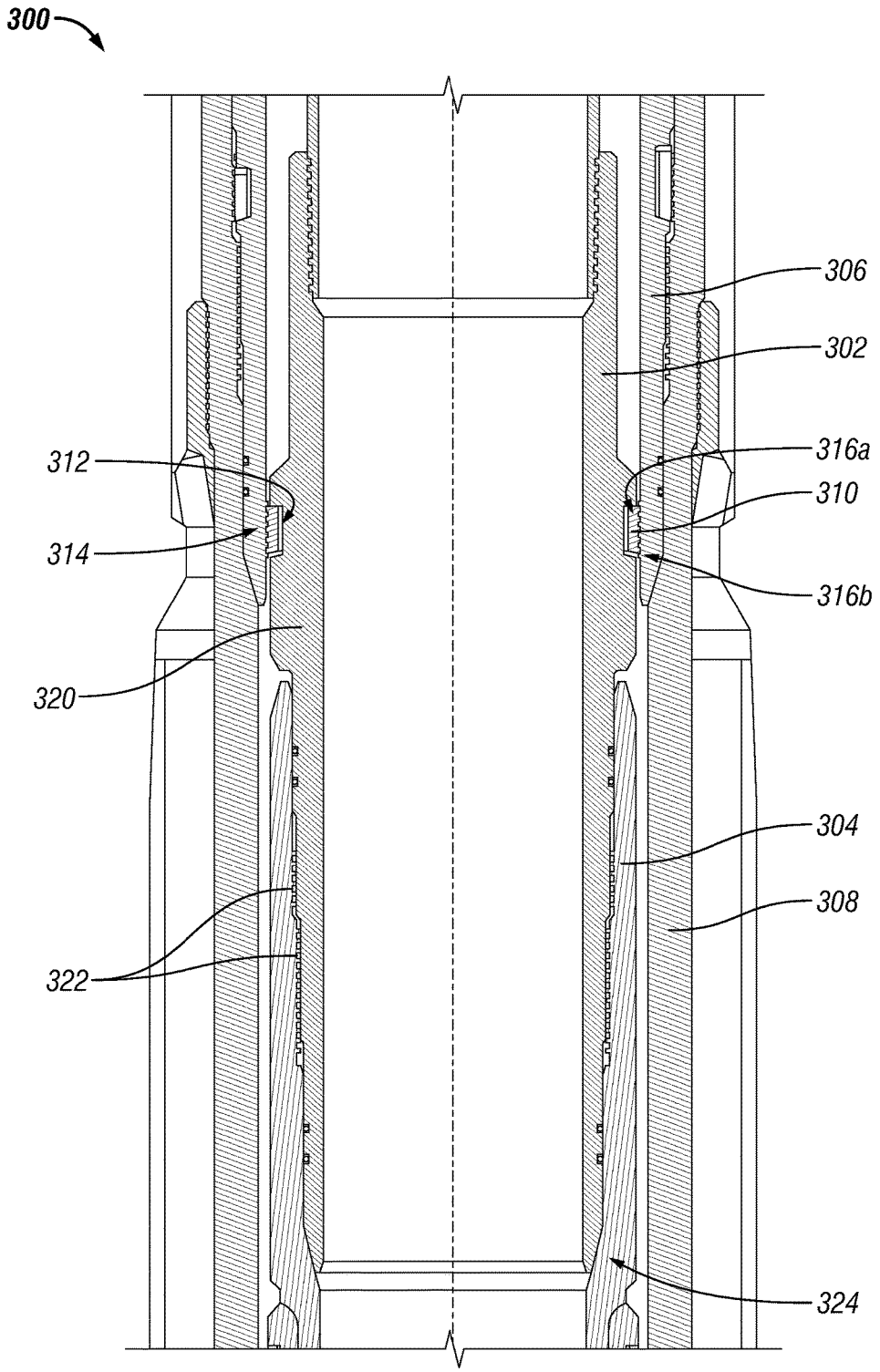
FIG. 3*a* shows a high-pressure, high-temperature tieback solution in accordance with various embodiments.

FIG. 3*a* shows a HPHT tieback solution 300 in accordance with various embodiments. The HPHT solution 300 is shown in a stabbed-in configuration with a HPHT production casing tieback tool 302 stabbed into a production casing mudline hanger 304. An intermediate casing tieback tool 306 and an intermediate casing mudline hanger 308 are annularly disposed about the HPHT production casing tieback tool 302 and the production casing mudline hanger 304. The intermediate casing tieback tool 306 and the intermediate casing mudline hanger 308 may be coupled (e.g., by threads, a ratchet-latch, metal-to-metal seals), thereby forming a tubular member that is disposed about both the HPHT production casing tieback tool 302 and the production casing mudline hanger 304.

A ratchet-latch mechanism 310 is positioned in a recessed portion 312 in the HPHT production casing tieback tool 302 and engages a threaded portion 314 of the intermediate casing tieback tool 306. The ratchet-latch 310 has a threaded external mating profile 316*a* that corresponds to a threaded internal mating profile 316*b* of the intermediate casing tieback tool 306 that enables the ratchet-latch 310, and thus the HPHT production casing tieback tool 302, to ratchet downward relative to the intermediate casing tieback tool 306 and thread onto the intermediate casing tieback tool 306.

Figure 3B:
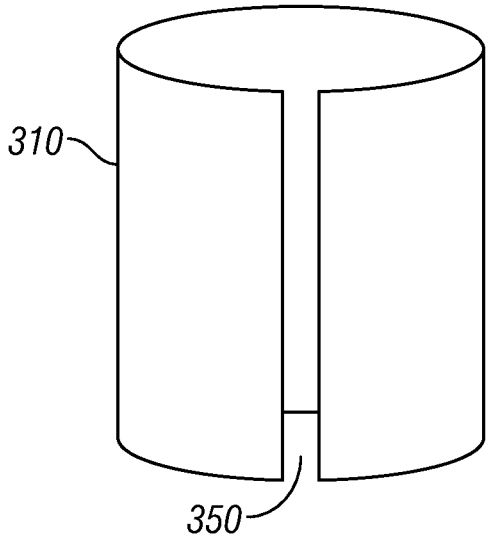
FIG. 3*b* shows an exemplary ratchet-latch sleeve in accordance with various embodiments.

In some embodiments, the ratchet-latch 310 has a longitudinal slot 350 as shown in FIG. 3*b* that allows the ratchet-latch 310 to expand or contract as necessary to provide sufficient clearance while ratcheting relative to the intermediate casing tieback tool 306. The ratchet-latch 310 may be designed such that the force required to induce a downward ratcheting motion is greater than the weight of the HPHT production casing tieback tool 302 and any casing weight bore by the HPHT production casing tieback tool 302 (i.e., the ratchet-latch 310 does not ratchet relative to the intermediate casing tieback tool 306 unless additional force is applied to the HPHT production casing tieback tool 302).

In accordance with various embodiments and as explained above, the intermediate casing tieback tool 306 and the intermediate casing mudline hanger 308 form a tubular that is annularly disposed about the HPHT production casing tieback tool 302 and the production casing mudline hanger 304. Thus, the inner diameter of the intermediate casing tieback tool 306 is greater than the inner diameter of the production casing mudline hanger 304. To facilitate contact between the ratchet latch 310 and the intermediate casing tieback tool 306, the recessed portion 312 is positioned on an annular extension 320 that has a greater radial wall thickness than the rest of the HPHT production casing tieback tool 302. Thus, the ratchet-latch 310 can contact the intermediate casing tieback tool 306 while allowing the HPHT production casing tieback tool 302 to stab into the production mudline casing hanger 304, which has a smaller inner diameter than the intermediate casing tieback tool 306.

In some embodiments, the interior face of the ratchet-latch 310 and the exterior face of the recessed portion 312 engage one another through a longitudinal slot/groove interface. Thus, when the HPHT production casing tieback tool 302 is rotated axially, the ratchet-latch 310 also rotates. The threaded exterior mating profile 316*a* of the ratchet-latch 310 and the corresponding threaded interior mating profile 316*b* of the intermediate casing tieback tool 306 cause the HPHT production casing tieback tool 302 to tighten downward relative to the production casing mudline hanger 304 in response to rotation of the HPHT production casing tieback tool 302. This bitingly engages metal-to-metal seals 322 and a tapered metal-to-metal seal 324 with the production casing mudline hanger 304.

Although the ratchet-latch 310 directly engages the intermediate casing tieback tool 306, the metal-to-metal seals 322, 324 directly engage the production mudline casing hanger 304 to form a liquid- and/or gas-impermeable seal between the HPHT production casing tieback tool 302 and the production casing mudline hanger 304. This seal allows hydrocarbons to flow through the resulting tubular to a production platform (e.g., platform 11 shown in FIG. 1) on the surface. In some embodiments, hydrocarbons may flow in a tubing string installed inside the production casing string, although gas may be injected in the annulus between the production casing string and the inner tubing string. In accordance with various embodiments, a thickness of the HPHT production casing tieback tool 302 and the production casing mudline hanger 304 is maintained such that there are no areas of reduced wall section thickness as in the prior art solution 200, shown in FIG. 2. Thus, the HPHT solution 300 is suited for HPHT applications because the ratchet-latch 310 does not require a reduced wall thickness section of the HPHT production casing tieback tool 302. Furthermore, the capacity of the HPHT production casing tieback tool 302 and the production casing mudline hanger 304 is at least as great as the capacity of an associated casing string below the production casing mudline hanger 304.

Figure 4:
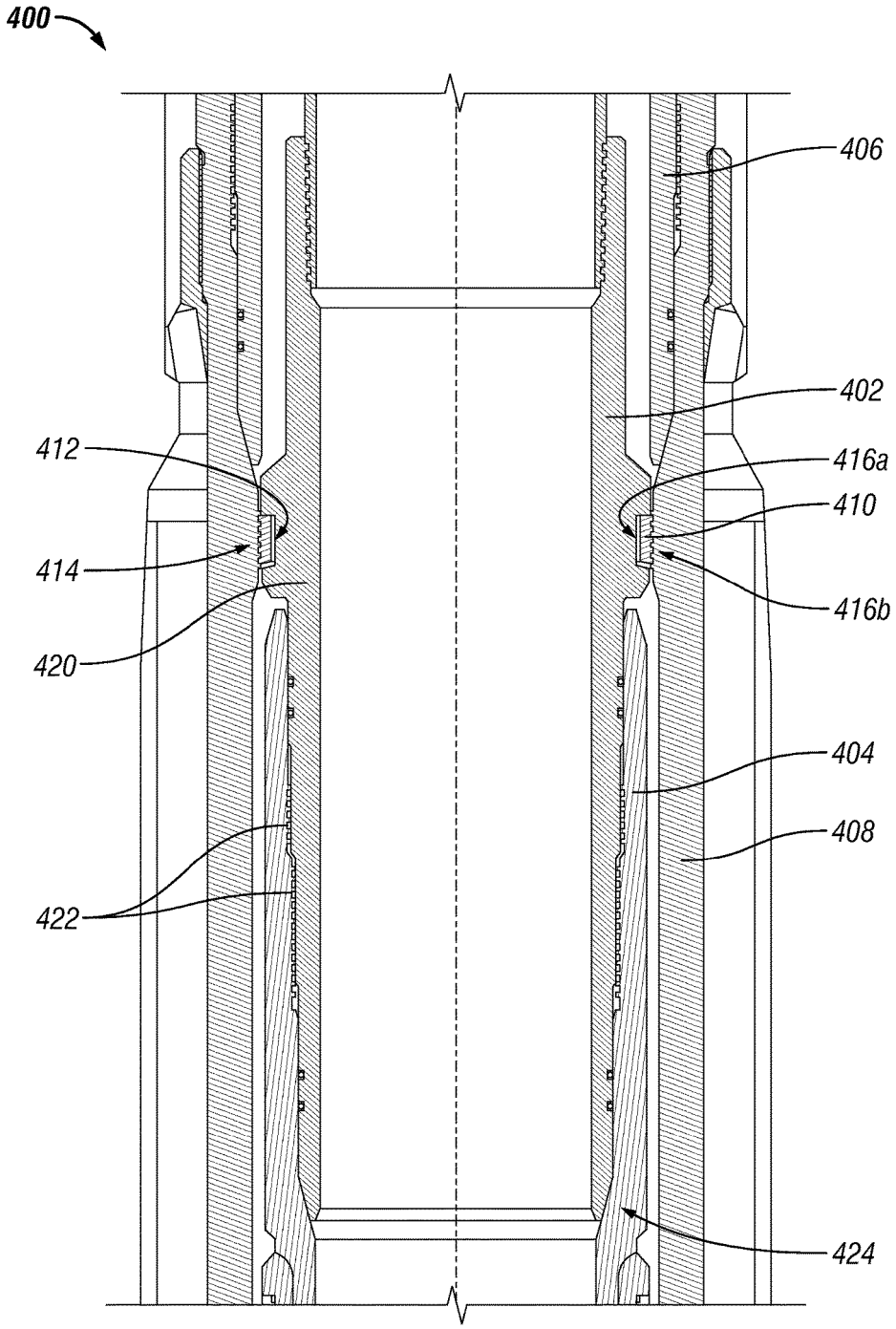
FIG. 4 shows an alternate high-pressure, high-temperature tieback solution in accordance with various embodiments.

FIG. 4 shows another HPHT tieback solution 400 in accordance with various embodiments. The HPHT solution 400 is shown in a stabbed-in configuration with a HPHT production casing tieback tool 402 stabbed into a production casing mudline hanger 404. An intermediate casing tieback tool 406 and an intermediate casing mudline hanger 408 are annularly disposed about the HPHT production casing tieback tool 402 and the production casing mudline hanger 404. The intermediate casing tieback tool 406 and the intermediate casing mudline hanger 408 may be coupled (e.g., by threads, a ratchet-latch, metal-to-metal seals), thereby forming a tubular member that is disposed about both the HPHT production casing tieback tool 402 and the production casing mudline hanger 404.

A ratchet-latch mechanism 410 is positioned in a recessed portion 412 in the HPHT production casing tieback tool 402 and engages a threaded portion 414 of the intermediate casing mudline hanger 408. The ratchet-latch 410 has a threaded external mating profile 416*a* that corresponds to a threaded external mating profile 416*b* of the intermediate casing mudline hanger 408 that enables the ratchet-latch 410, and thus the HPHT production casing tieback tool 402, to ratchet downward relative to the intermediate casing mudline hanger 408 and thread onto the intermediate casing mudline hanger 408.

In some embodiments, the ratchet-latch 410 has a longitudinal slot 350 as shown in FIG. 3*b* that allows the ratchet-latch 410 to expand or contract as necessary to provide sufficient clearance while ratcheting relative to the intermediate casing mudline hanger 408. The ratchet-latch 410 may be designed such that the force required to induce a downward ratcheting motion is greater than the weight of the HPHT production casing tieback tool 402 and any casing weight bore by the HPHT production casing tieback tool 402 (i.e., the ratchet-latch 410 does not ratchet relative to the intermediate casing mudline hanger 408 unless additional force is applied to the HPHT production casing tieback tool 402).

In accordance with various embodiments and as explained above, the intermediate casing tieback tool 406 and the intermediate casing mudline hanger 408 form a tubular that is annularly disposed about the HPHT production casing tieback tool 402 and the production casing mudline hanger 404. Thus, the inner diameter of the intermediate casing mudline hanger 408 is greater than the inner diameter of the production casing mudline hanger 404. To facilitate contact between the ratchet latch 410 and the intermediate casing mudline hanger 408, the recessed portion 412 is positioned on an annular extension 420 that has a greater radial thickness than the rest of the HPHT production casing tieback tool 402. Thus, the ratchet-latch 410 can contact the intermediate casing mudline hanger 408 while allowing the HPHT production casing tieback tool 402 to stab into the production mudline casing hanger 404, which has a smaller inner diameter than the intermediate casing mudline hanger 408.

In some embodiments, the interior face of the ratchet-latch 410 and the exterior face of the recessed portion 412 engage one another through a longitudinal slot/groove interface. Thus, when the HPHT production casing tieback tool 402 is rotated axially, the ratchet-latch 410 also rotates. Rotation of the HPHT production casing tieback tool 402 tightens the HPHT production casing tieback tool 402 downward relative to the production casing mudline hanger 404 due to the threaded exterior mating profile 416*a* of the ratchet-latch 410 and the corresponding threaded interior mating profile 416*b* of the intermediate casing mudline hanger 408. Due to this, metal-to-metal seals 422 and a tapered metal-to-metal seal 424 bitingly engage the production casing mudline hanger 404.

The metal-to-metal seals 422, 424 directly engage the production mudline casing hanger 404, forming a liquid-impermeable seal between the HPHT production casing tieback tool 402 and the production casing mudline hanger 404. This seal allows hydrocarbons to flow through the resulting tubular to a production platform (e.g., platform 11 shown in FIG. 1) on the surface. In some embodiments, hydrocarbons may flow in a tubing string installed inside the production casing string, although gas may be injected in the annulus between the production casing string and the inner tubing string. In accordance with various embodiments, the HPHT production casing tieback tool 402 and the production casing mudline hanger 404 maintain a wall thickness such that there are no areas of reduced wall thickness as in the prior art solution 200, shown in FIG. 2. Thus, the HPHT solution 400 is suited for HPHT applications because the ratchet-latch 410 does not require a reduced wall section of the HPHT production casing tieback tool 402. Furthermore, the capacity of the HPHT production casing tieback tool 402 and the production casing mudline hanger 404 is at least as great as the capacity of an associated casing string below the production casing mudline hanger 404.

The recessed portions 312, 412 of the HPHT production casing tieback tool 302, 402 do not reduce the wall section thickness of the HPHT production casing tieback tool 302, 402 (e.g., by being located on an annular extension 320, 420) as long as the ratchet-latch 310, 410 directly engages a tubular other than the production casing mudline hanger 304, 404. Even so, the HPHT production casing tieback tool 302, 402 directly engages the production casing mudline hanger 304, 404 to form metal-to-metal seals 322, 324, 422, 424 to form a liquid-impermeable seal between the HPHT production casing tieback tool 302, 402 and the production casing mudline hanger 304, 404. This liquid-impermeable seal allows hydrocarbons from a HPHT well to flow through the resulting tubular to the surface.

While specific embodiments have been shown and described, modifications can be made by one skilled in the art without departing from the spirit or teaching of this invention. For example, the ratchet-latch of the HPHT production casing tieback may directly engage a tubular other than the intermediate casing mudline hanger or the intermediate casing tieback tool. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A high-pressure, high-temperature tieback system for connecting a subsea mudline suspension wellhead to a surface wellhead by connecting a tieback string between the surface wellhead and a production casing mudline hanger suspended in the mudline suspension wellhead, the high-pressure, high-temperature tieback system comprising:

a production casing tieback tool connectable to the tieback string and comprising a tubular member comprising an annular extension of increased wall thickness and a ratchet-latch sleeve comprising a helical threaded mating profile formed on an outer surface thereof, the ratchet-latch sleeve being located in a recess in the annular extension and axially bounded by portions of the annular extension having a greater radial wall thickness than the remaining upper and lower portions of the production casing tieback tool;

wherein the tieback tool is configured to stab into the mudline hanger such that the ratchet-latch sleeve engages and ratchets down a helical threaded mating profile formed on an inner surface of a tubular other than the production casing mudline hanger; and wherein the tieback tool is rotatable relative to the tubular on the mating profile so as to urge the tieback tool downward relative to the mudline hanger.

2. The high-pressure, high-temperature tieback system of claim 1 wherein the ratchet-latch sleeve is configured to directly engage an intermediate casing tieback tool.

3. The high-pressure, high-temperature tieback system of claim 1 wherein the ratchet-latch sleeve is configured to directly engage an intermediate casing mudline hanger.

4. The high-pressure, high-temperature tieback system of claim 1 wherein the annular extension comprises a raised axial segment of the production casing tieback tool, such that a radial wall thickness of the recessed portion is greater than or equal to the radial wall thickness of the production casing tieback tool other than the raised axial segment.

5. The high-pressure, high-temperature tieback system of claim 1 wherein the production casing tieback tool further comprises a metal-to-metal seal that is configured to sealingly engage the production casing mudline hanger as a result of the production casing tieback tool being urged downward relative to the production casing mudline hanger.

6. The high-pressure, high-temperature tieback system of claim 1 wherein the tubular other than the production casing mudline hanger comprises an intermediate casing tieback tool.

7. The high-pressure, high-temperature tieback system of claim 1 wherein the tubular other than the production casing mudline hanger comprises an intermediate casing mudline hanger.

8. A method of stabbing a high-pressure, high-temperature tieback tool into a mudline hanger of a high-pressure, high-temperature well, comprising:

applying motive force to the tieback tool to engage a helical threaded mating profile formed on an outer surface of a ratchet-latch sleeve with a helical threaded mating profile formed on an inner surface of a tubular other than the mudline hanger, the ratchet-latch sleeve located in a recess in an annular extension of increased wall thickness of the tieback tool and axially bounded by portions of the annular extension having a greater radial wall thickness than the remaining upper and lower portions of the tieback tool; and coupling the tieback tool to the mudline hanger by rotating the tieback tool relative to the tubular other than the mudline hanger to move the tieback tool downward relative to the mudline hanger.

9. The method of claim 8 wherein moving the tieback tool downward causes a metal-to-metal seal of the tieback tool to seal against an inner surface of the mudline hanger.

10. The method of claim 8 further comprising extracting hydrocarbons from the high-pressure or high-temperature well through the tieback and the mudline casing.

11. The method of claim 8 wherein the ratchet-latch sleeve is disposed in a recessed portion of an annular extension of increased wall thickness of the tieback tool.

12. A high-pressure, high-temperature tieback system comprising:

a subsea mudline suspension wellhead a tieback string coupled to the mudline suspension wellhead;

a production casing tieback tool connectable to the tieback string and comprising a tubular member comprising an annular extension of increased wall thickness and a ratchet-latch sleeve comprising a helical threaded mating profile formed on an outer surface thereof, the ratchet-latch sleeve being located in a recess in the annular extension and axially bounded by portions of the annular extension having a greater radial wall thickness than the remaining upper and lower portions of the production casing tieback tool;

a production casing mudline hanger suspended in the mudline suspension wellhead and disposed about the production casing tieback tool;

wherein the tieback tool is configured to stab into the mudline hanger such that the ratchet-latch sleeve engages and ratchets down a helical threaded mating profile formed on an inner surface of a tubular other than the production casing mudline hanger; and wherein the tieback tool is rotatable relative to the tubular on the mating profile so as to urge the tieback tool downward relative to the mudline hanger.

* * * * *